US005107733A

United States Patent [19]

Palmatier et al.

[11] Patent Number: 5,107,733

[45] Date of Patent: Apr. 28, 1992

[54] APPARATUS FOR CUTTING AND TRANSPORTING A PAPER WEB IN A FOLDING APPARATUS OF A PRINTING PRESS

[75] Inventors: Roland T. Palmatier, Durham; Michael L. Hearn, Dover, both of N.H.

[73] Assignee: Heidelberg Harris GmbH, Dover, N.H.

[21] Appl. No.: 715,369

[22] Filed: Jun. 14, 1991

[51] Int. Cl.[5] ..... B65H 35/08; B26D 1/40

[52] U.S. Cl. ..... 83/176; 83/155; 83/346; 83/674; 83/678; 271/188; 493/352

[58] Field of Search ..... 83/17, 155, 176, 346, 83/347, 674, 678; 226/95; 271/161, 188, 209; 493/352, 353

[56] References Cited

U.S. PATENT DOCUMENTS 1,337,778 4/1920 Leonard ..... 83/176 X 3,890,886 6/1975 Fessler et al. ..... 271/188 X

FOREIGN PATENT DOCUMENTS 0249874 12/1987 European Pat. Off. .

*Primary Examiner*—Hien H. Phan

*Assistant Examiner*—Raymond D. Woods

*Attorney, Agent, or Firm*—Tarolli, Sundheim & Covell

[57] ABSTRACT

An apparatus for transporting a web in a printing press comprises a pair of cutting cylinders for cutting web sections from the web, and a transporting device for transporting the web sections away from the cutting cylinders. The first cutting cylinder has at least one cutting anvil, and the second cutting cylinder has at least one cutting knife which meets the cutting anvil at a nip between the cutting cylinders to cut the web moving through the nip. A plurality of strips are supported on the first cutting cylinder and a plurality of strips are supported on the second cutting cylinder. The strips have positions on the cutting cylinders in which they impress a temporary reinforcing profile onto each newly formed leading portion of the web when the strips move through the nip. At least one smoothing surface is supported on the first cutting cylinder and at least one smoothing surface is supported on the second cutting cylinder. The smoothing surfaces have positions on the cutting cylinders wherein the smoothing surfaces remove the temporary reinforcing profile from the leading portion of the web when the smoothing surfaces move through the nip.

12 Claims, 3 Drawing Sheets

APPARATUS FOR CUTTING AND TRANSPORTING A PAPER WEB IN A FOLDING APPARATUS OF A PRINTING PRESS

FIELD OF THE INVENTION

The present invention relates to an apparatus for transporting a paper web in a printing press.

BACKGROUND OF THE INVENTION

European Patent Publication No. 0 249 874 discloses an apparatus which forces a V-shaped configuration upon the leading portion of a stream of printed products. The apparatus includes two rotatable shafts positioned opposite one another. Each shaft supports rollers with differing diameters. The shafts are arranged opposite one another with each roller on one shaft located opposite a roller of a different diameter on the other shaft. The rollers impress a V-shaped configuration upon the printed products moving between the two shafts.

When multiple page printed products are produced in a printing press, a stacked web is formed as several webs converge into an overlapping arrangement. The stacked web is moved between a pair of cutting cylinders which, with cutting knives, separate the stacked web into web sections. After each cut is made, the overlapping layers of the stacked web can be spread apart at their leading edges by air resistance when the stacked web moves from the pair of cutting cylinders to an adjacent transport device. Spreading open of the stacked web makes a correct, position-exact transfer of the beginning of the stacked web into the transport device impossible.

The apparatus disclosed in European Patent Publication 0 249 874 cannot be located in a position to receive the stacked web as it moves away from the pair of cutting cylinders in a printing press as described above.

When one of the layers of such a web spreads open when entering the transport device, it can cause paper jams which lead to uselessness of the web. Long and costly down time of the apparatus is the result.

SUMMARY OF THE INVENTION

The present invention overcomes the foregoing and other disadvantages of the prior art, and provides an apparatus which assures correct and position-exact transporting of a web in a printing press.

In accordance with the present invention, an apparatus for transporting a web in a printing press comprises a pair of cutting cylinders and a transport device for moving web sections away from the cutting cylinders. The transport device moves the web sections to further processing apparatus, such as a folding apparatus. One of the cutting cylinders has at least one cutting anvil, and the other cutting cylinder has at least one cutting knife. Each of the cutting cylinders has a plurality of strips supported thereon. The strips on each cutting cylinder extend circumferentially, and are axially spaced from each other. When the strips move through the nip between the two cutting cylinders, they impart a reinforcing profile to the leading portion of the web moving through the nip. Each of the cutting cylinders also has a smoothing surface supported thereon. The smoothing surfaces move behind the strips through the nip between the two cutting cylinders, and remove the reinforcing profile from the leading portion of the web moving through the nip.

The invention advantageously enables exact guidance of each successive leading portion of the web which moves from the nip between the two cutting cylinders toward the transport device, because a reinforcing profile is imparted to each successive leading portion of the web.

The reinforcing profile at each successive leading portion of the web assures that all overlapping layers of the web are moved together and are led into the transport device without the need for further guidance. Thus, web jams and the costly down time associated therewith are avoided.

In a preferred embodiment of the present invention, the reinforcing profile, which is periodically imparted to the web as the web moves through the nip between the cutting cylinders, is removed from the web by the smoothing surfaces on the cutting cylinders before the leading web portion is cut away from the web to become a cut web section.

The preferred embodiment of the invention thus reinforces each newly formed leading portion of the web so that it moves from the cutting cylinders toward the transport device without having layers thereof becoming separated. The smoothing surfaces of the cutting cylinders remove the reinforcing profile from the web as it moves through the nip between the cutting cylinders so that a lasting deformation of the web does not remain.

Further in accordance with the preferred embodiment of the invention, the transport device comprises a pair of rollers and a pair of belts. The belts move on the rollers and engage the cut web sections to move the cut web sections away from the cutting cylinders. The arc length of the strips, which extend circumferentially on the cutting cylinders, corresponds to the distance across the space between the nip at the cutting cylinders and the axes of the rollers of the transport device.

The preferred embodiment of the invention thus imparts a reinforcing profile to the leading portion of the web which enables it to bridge the space between the nip at the cutting cylinders and the transport device.

Still further in accordance with the preferred embodiment of the invention, the reinforcing profile periodically imparted to the web extends across the entire width of the web.

The strips and the smoothing surfaces are preferably formed of rubber or synthetic material, and are adhered to the surfaces of the cutting cylinders. Thus, existing cylinders for paper processing machines in a printing press can be retrofitted in accordance with the present invention. Alternately, the strips and/or the smoothing surfaces are formed as thin plates having a curvature corresponding with the curvature of the cutting cylinders on which they are mounted.

In the preferred embodiment, the sum of the arc length of the strips and the arc length of the smoothing surface which follows the strips substantially equals the circumferential distance between the cutting knives which follow one another on the cutting cylinder having cutting knives. Likewise, the sum of the arc length of the strips and the arc length of the smoothing surface which follows the strips is substantially equal to the circumferential distance between the anvils which follow one another on the other cutting cylinder. Thus, almost the entire circumference of each cutting cylinder is utilized for supporting transport of the paper web.

BRIEF DESCRIPTION OF THE DRAWINGS

The foregoing and other features of the present invention will become apparent to one skilled in the art upon reading the following description of a preferred embodiment, in view of the accompanying drawings, wherein.

DESCRIPTION OF A PREFERRED EMBODIMENT

Figure 1:
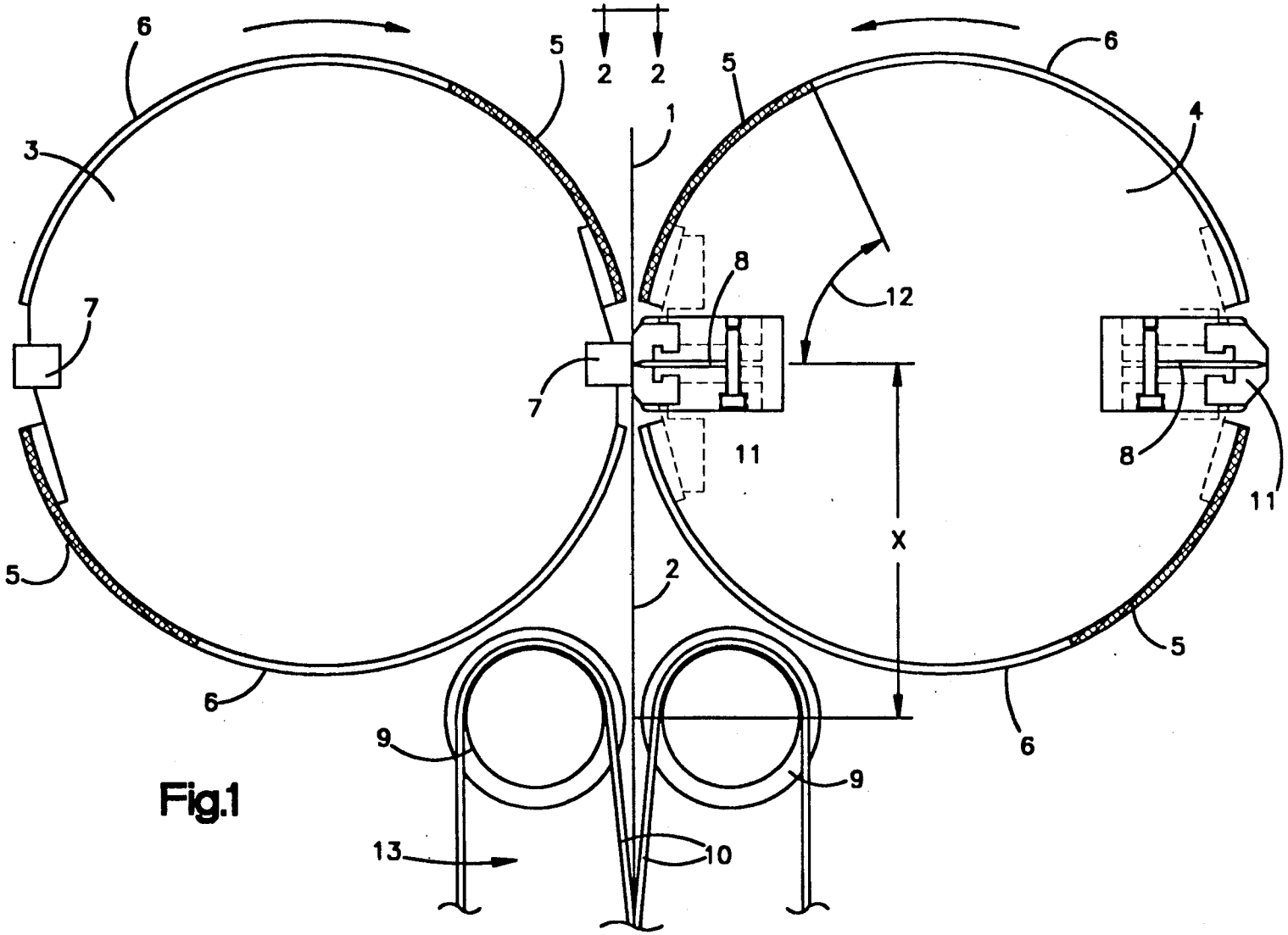
FIG. 1 is a side view of an apparatus constructed in accordance with the present invention.

As shown in FIG. 1, a printing apparatus constructed in accordance with the present invention comprises first and second cutting cylinders 3 and 4. A web 1, preferably paper, moving through the nip between the first and second cutting cylinders 3 and 4 is cut into web sections 2. The web 1 is cut by cutting knives 8 which are located at diametrically opposed positions on the second cutting cylinder 4. The cutting knives 8 meet with cutting anvils 7 which are located at diametrically opposed positions on the first cutting cylinder 3. The web sections 2, which have been separated from the web 1 by cutting at the nip, extend into a feed-in or entering region of a transport device 13. The web sections 2 are subsequently engaged by moving belts 10, and are thereby carried away for further processing, such as folding.

A plurality of strips 5 mounted on the first and second cutting cylinders 3 and 4 extend circumferentially from the cutting anvils 7 and the cutting knives 8, respectively. Smoothing surfaces 6 mounted on the first and second cutting cylinders 3 and 4 extend circumferentially from the strips 5 to the next following cutting anvil 7 and to the next following cutting knife 8, respectively.

When a web section 2 is separated from the paper web 1 upon cooperation of a cutting knife 8 and a cutting anvil 7, the newly formed leading portion of the web 1 is acted upon by the strips 5. The strips 5 periodically impress a reinforcing profile onto the web 1. The arc lengths 12 of the strips 5 measured along the circumferences of the first cutting cylinder 3 and the second cutting cylinder 4 are such that the length of the reinforcing profile imparted to the leading portion of the web 1 corresponds approximately with the distance across the space between the nip at the pair of cutting cylinders 3 and 4 and the rotation axes of the rollers 9.

In FIG. 1 this distance is labelled with "X." In the preferred embodiment of the invention, the arc length 12 is equal to the distance "X." Shortly before the leading portion of the paper web 1, which is impressed with a reinforcing profile, is gripped by the transport belts 10, that portion of the paper web 1 is acted upon by the smoothing surfaces 6 when the smoothing surfaces 6 move into the nip behind the strips 5. This effects flattening of the reinforcing profile at the leading portion of the web 1. The reinforcing profile is thus removed from the leading portion of the web 1 before the leading portion of the web 1 is cut and moved into engagement with the transport belts 10.

The periodic profiling of the web 1 assures a secure bridging over of the empty space between the pair of cutting cylinders 3 and 4 and the feed-in or entrance region of the transport device 13. The smoothing action effected by the smoothing surfaces 6 extends from the nip to the leading edge of the web 1. The smoothed section of the web is then cut as the next cutting knife 8 and cutting anvil 7 move into the nip behind the smoothing surfaces 6. The cut section 2 of the web thus does not have a reinforcing profile. The cut section 2 of the web enters the transport device 13 and is gripped by the transport belts 10 in a smooth, flattened condition. The timely application and removal of the reinforcing profiles from the successive leading portions of the paper web 1 before the cut sections 2 reach the transport device 13 assures that a permanent deformation of the cut web sections 2 is not impressed into the web sections 2 by the transport belts 10. The quality of the end products of the web sections 2 is not impaired, because the reinforcing profile is removed from the web sections 2 before the web sections 2 are grasped between the transport belts 10. This is especially advantageous when further processing of the web sections 2 involves folding.

In addition to flattening the leading portion of the web 1, the smoothing surfaces 6 also support the leading portion of the web 1 as it moves away from the nip. The web 1, during movement, always remains tightly stretched. A separation of the layers, if any, of the web sections 2 is thus prevented. The air resistance experienced by the web in the free space between the pair of cutting cylinders 3 and 4 and the transport device 13 is not able to separate overlying layers of the web 1, because the web 1 is stabilized by the reinforcing profile. The web 1 and web section 2 can therefore be moved at higher speeds than in the prior art.

The strips 5 and the smoothing surfaces 6 can also be built as shell-like bodies, preferably metallic, which are mounted onto cylinders in folders or other paper processing machines.

Figure 2:
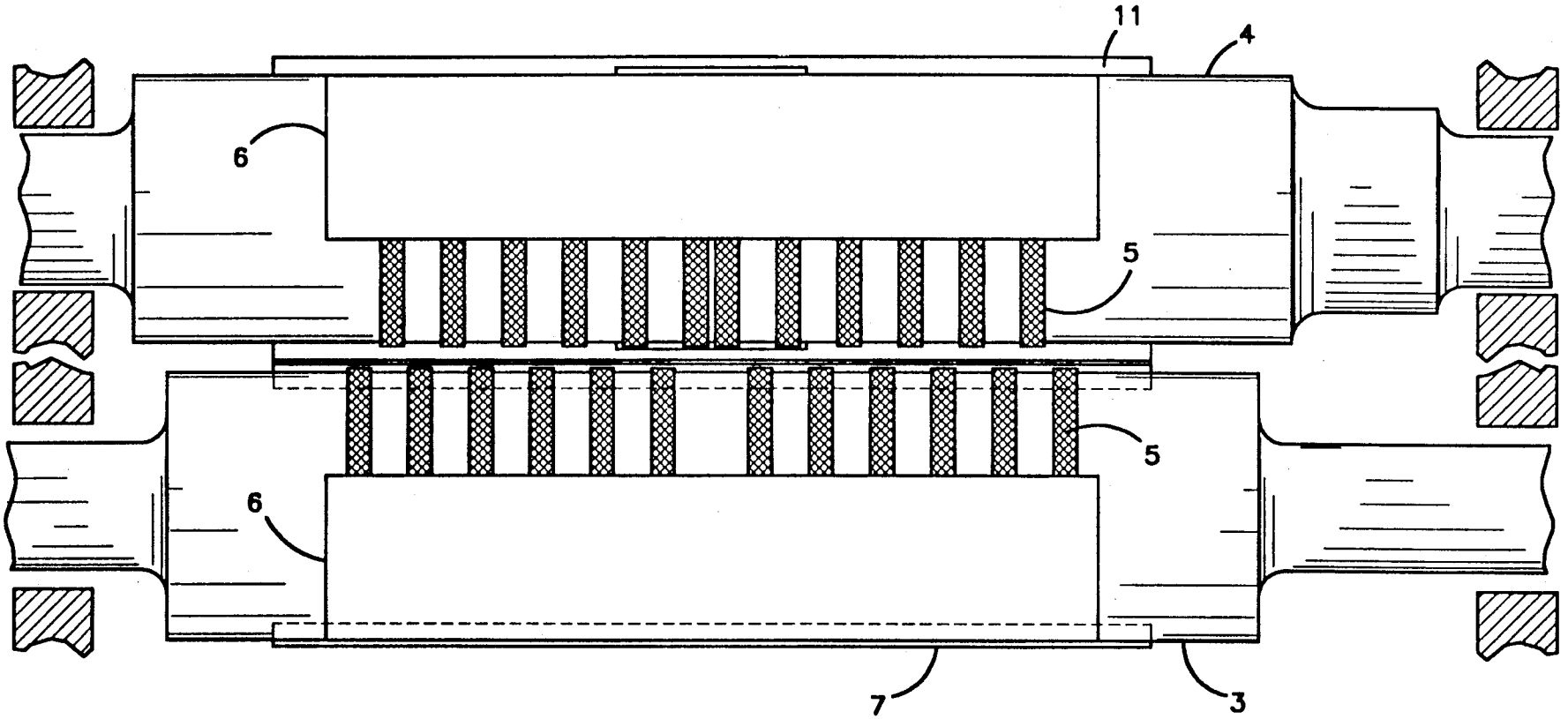
FIG. 2 is a view taken on line 2—2 of FIG. 1.

As shown in FIG. 2, each one of the strips 5 mounted on the cutting cylinders 3 and 4 extends longitudinally in a circumferential direction and is spaced axially from each adjacent strip 5. Additionally, each strip 5 on one of the cutting cylinders 3 and 4 is offset axially from each strip 5 on the other one of the cutting cylinders 3 and 4. In this preferred arrangement, the numerous strips 5 impart a generally corrugated reinforcing profile to the web 1 each time they engage the leading web portion moving through the nip between the rotating cylinders 3 and 4. The corrugated profile includes numerous bends in the web which are spaced apart across the width of the web, and thus reinforces the web substantially across the entire width of the web. Alternately, a lesser number of bends or a single bend could be imparted to the web to provide a corresponding degree of reinforcement as desired. For example, a single strip 5 could be used on each of the cutting cylinders 3 and 4 to form a reinforcing profile including a single bend in the web. The strips 5 can be fastened individually or can also be premounted on a thin base which is then mounted onto the cylinders 3 and 4. Immediately following the strips 5 are the smoothing surfaces 6. The smoothing surfaces 6 extend circumferentially on the cutting cylinders 3 and 4 from the strips 5 to the next following cutting anvil 7 and cutting knife 8, respectively. In the preferred embodiment, the cylinders 3 and 4 have only two cutting anvils 7 and cutting knives 8, but additional cutting anvils 7 and cutting knives 8 could be used.

As shown in FIG. 2, the first and second cutting cylinders 3 and 4 are supported for rotation in the side walls of a folding apparatus in a printing press.

Figure 3:
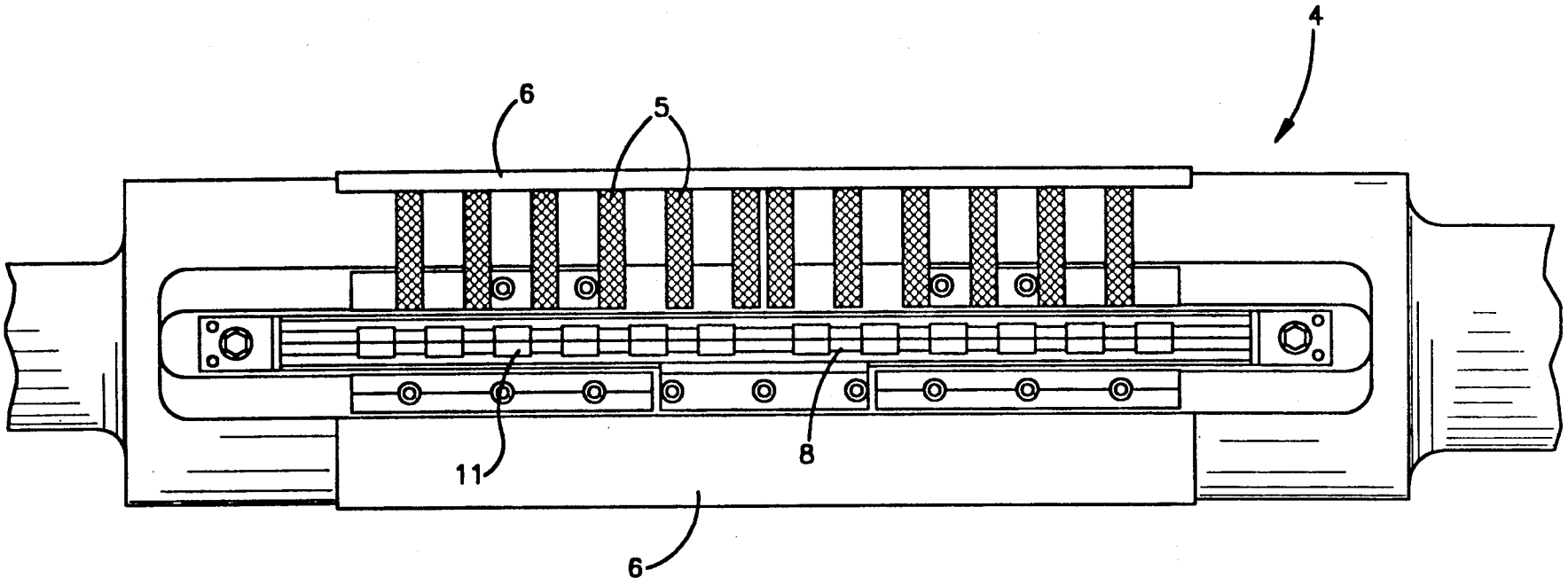
FIG. 3 is a view of one of the cylinders shown in FIGS. 1 and 2.

As shown in FIG. 3, the cutting knives 8 extend through cheekwoods 11. The strips 5 and the smoothing surfaces 6 extend between recesses in which the cheekwoods 11 are located. Almost the entire circumference of the cylinders 3 and 4 is thus used for profiling and smoothing of the web 1.

The invention has been described with reference to a preferred embodiment. Improvements, changes and modifications will become apparent to those skilled in the art. Such improvements, changes and modifications are intended to be included within the scope of the appended claims.

We claim:

1. An apparatus for transporting a web in a printing press, said apparatus being characterized by:

a first cutting cylinder (3) having at least one cutting anvil (7);

a second cutting cylinder (4) having at least one cutting knife (8) which meets said cutting anvil (7) at a nip between said first and second cutting cylinders (3, 4) and which cuts the web (1) to form a leading portion of the web (1) moving through said nip;

strips (5) supported on said first and second cutting cylinders (3 and 4), said strips (5) having positions on said first and second cutting cylinders (3, 4) in which said strips impress a temporary reinforcing profile onto each newly formed leading portion of the web (1) when said strips (5) move through said nip;

smoothing surfaces (6) on said first and second cutting cylinders (3, 4), said smoothing surfaces (6) having positions on said first and second cutting cylinders (3, 4) wherein said smoothing surfaces (6) remove the temporary reinforcing profile from the leading portion of the web (1) when said smoothing surfaces (6) move through said nip behind said strips (5); and a transport apparatus (13) for moving cut web sections (2) away from said first and second cutting cylinders (3 and 4).

2. An apparatus as defined in claim 1 wherein said cutting knife (8) and said cutting anvil (7) cut the leading portion from the web (1) to form a web section (2) after said strips (5) impart a temporary reinforcing profile to the leading portion of the web (1), said smoothing surfaces (6) removing the temporary reinforcing profile from the leading portion of the web (1) before said cutting knife (8) and said cutting anvil (7) cut the leading portion from the web (1).

3. An apparatus as defined in claim 1, and further characterized by said transport apparatus (13) including a pair of rollers (9) and a pair of transport belts (10) which move on said rollers (9) and which converge to grasp the web sections (2), said rollers (9) having axes spaced from said nip along the path of movement of said web sections (2), said strips (5) extending circumferentially about said cutting cylinders (3 and 4), said strips (5) having an arc length approximately equal to a distance between said nip and said axes of said rollers (9).

4. An apparatus as defined in claim 1, and further characterized by said strips (5) imparting a temporary reinforcing profile extending substantially across the entire width of the web (1).

5. An apparatus as defined in claim 1, and further characterized by said strips (5) and said smoothing surfaces (6) being adhered to said first and second cutting cylinders (3 and 4).

6. An apparatus as defined in claim 1, and further characterized by said strips (5) and said smoothing surfaces (6) being formed of rubber or synthetic material.

7. An apparatus as defined in claim 1, and further characterized by said strips (5) and said smoothing surfaces (6) being formed on plates which are mounted on said first and second cutting cylinders (3 and 4), said plates each having a curvature corresponding with the curvature of the respective cutting cylinder (3 or 4).

8. An apparatus as defined in claim 1, and further characterized by said first cutting cylinder (3) having a pair of said cutting anvils (7) spaced circumferentially from each other, said strips (5) and said smoothing surface (6) on said first cutting cylinder (3) being located between said pair of cutting anvils (7), the sum of the arc length of said strips (5) and the arc length of said smoothing surface (6) being substantially equal to the circumferential distance between said cutting anvils (7), said second cutting cylinder (4) having a pair of said cutting knives (8) spaced circumferentially from each other, said strips (5) and said smoothing surface (6) on said second cutting cylinder (4) being located between said pair of cutting knives (8), the sum of the arc length of said strips (5) and the arc length of said smoothing surface (6) on said second cutting cylinder (4) being substantially equal to the circumferential distance between said pair of cutting knives (8).

9. A web handling apparatus comprising a pair of rotatable cylinders (3, 4), said cylinders (3, 4) defining a nip through which the web moves between said cylinders (3, 4) and having cutting means (7, 8, 11) for cutting the web into web sections, said cutting means (7, 8, 11) cutting the web to define a leading edge of a leading web portion moving through said nip, said web handling apparatus being characterized by:

said cylinders (3, 4) each having a first surface means (5) for imparting a temporary reinforcing profile to the leading web portion; and said cylinders (3, 4) each having a second surface means (6) for removing the temporary reinforcing profile from the leading web portion.

10. A web handling apparatus as defined in claim 9 and further characterized by said second surface means (6) removing the temporary reinforcing profile from the leading web portion before said cutting means (7, 8, 11) cuts the leading web portion.

11. A web handling apparatus as defined in claim 9, wherein said cutting means (7, 8, 11) cuts the leading web portion to form a web section (2) moving away from said nip, and further characterized by a transporting means (13) for moving the web sections (2) away from said nip, said transporting means (13) including members (10) having movable surfaces which contact and move the web sections (2), said movable surfaces and said nip defining an open space therebetween, said first surface means (5) supporting the leading web portion to move across said open space toward said movable surfaces, said second surface means (6) removing the temporary reinforcing profile from the leading web portion before the leading web portion moves beyond a predetermined distance (x) across said open space from said nip toward said movable surfaces.

12. A web handling apparatus as defined in claim 9, and further characterized by said first surface means (5) comprising at least one strip (5) extending circumferentially on said first cutting cylinder (3), and at least one strip (5) extending circumferentially on said second cutting cylinder (4) at a location axially offset from the location of said strip (5) on said first cutting cylinder (3).

* * * * *